US009931734B2

(12) United States Patent
Fogelberg

(10) Patent No.: US 9,931,734 B2
(45) Date of Patent: Apr. 3, 2018

(54) CARRIER DISK, SYSTEM COMPRISING SUCH CARRIER DISK AND FLOOR GRINDING MACHINE

(71) Applicant: HTC Sweden AB, Soederkoeping (SE)

(72) Inventor: Andreas Fogelberg, Soederkoeping (SE)

(73) Assignee: HTC SWEDEN AB, Soederkoeping (SE)

( * ) Notice: Subject to any disclaimer, the term of this patent is extended or adjusted under 35 U.S.C. 154(b) by 35 days.

(21) Appl. No.: 14/707,082

(22) Filed: May 8, 2015

(65) Prior Publication Data

US 2016/0207170 A1 Jul. 21, 2016

(30) Foreign Application Priority Data

Jan. 20, 2015 (SE) ..... 1550043

(51) Int. Cl.

| | |
|---|---|
| ***B24D 7/18*** | (2006.01) |
| ***B24B 41/047*** | (2006.01) |
| ***B24B 55/02*** | (2006.01) |
| ***B24B 55/06*** | (2006.01) |
| ***B24D 7/06*** | (2006.01) |
| ***B24D 7/10*** | (2006.01) |
| ***B24B 7/18*** | (2006.01) |

(52) U.S. Cl.

CPC ..... *B24D 7/18* (2013.01); *B24B 7/186* (2013.01); *B24B 41/047* (2013.01); *B24B 55/02* (2013.01); *B24B 55/06* (2013.01); *B24D 7/066* (2013.01); *B24D 7/10* (2013.01)

(58) Field of Classification Search

CPC ..... B24B 41/047; B24B 55/02; B24B 55/06; B24B 7/186; B24D 7/006; B24D 7/10; B24D 7/18

See application file for complete search history.

(56) References Cited

U.S. PATENT DOCUMENTS

| | | | | | |
|---|---|---|---|---|---|
| 1,470,957 | A | * | 10/1923 | Cavicchi | B24D 7/066 451/548 |
| 1,972,315 | A | * | 9/1934 | Ramey | H02K 9/26 15/DIG. 8 |
| 2,307,312 | A | * | 1/1943 | Whiting | B24D 7/10 451/548 |
| 2,452,268 | A | * | 10/1948 | Schumann | B24B 23/02 173/213 |

(Continued)

FOREIGN PATENT DOCUMENTS

| | | |
|---|---|---|
| EP | 0050233 A2 | 4/1982 |
| EP | 0836911 A1 | 4/1998 |

(Continued)

*Primary Examiner* — Joseph J Hail
*Assistant Examiner* — Arman Milanian
(74) *Attorney, Agent, or Firm* — Hultquist, PLLC; Steven J. Hultquist

(57) ABSTRACT

The present disclosure provides a carrier disk for holding at least one cutting, grinding or polishing element in a floor grinding machine. The carrier disk comprises a carrier body having a downwardly exposed face, at which the grinding element is arranged, a opening formed in the carrier body and a plurality of flanges extending axially from the carrier body and between the opening and a radially outer edge of the carrier body.

17 Claims, 7 Drawing Sheets

(56) References Cited

U.S. PATENT DOCUMENTS 2,455,597 A * 12/1948 Metzger ..... B24B 13/01 29/DIG. 66
D155,085 S * 9/1949 Goldberg ..... D15/126
2,527,762 A 10/1950 Pratt
2,735,244 A * 2/1956 Brown ..... B24D 7/066 451/548
2,795,903 A * 6/1957 Titcomb ..... B24D 7/066 451/548
2,819,568 A * 1/1958 Kasick ..... B24D 7/10 451/449
3,754,359 A 8/1973 Scandalestos
4,224,768 A * 9/1980 Denney ..... B24B 19/02 451/548
4,612,734 A * 9/1986 Nakajima ..... B24B 23/02 451/358
4,930,264 A * 6/1990 Huang ..... B24B 55/102 15/97.1
5,243,790 A * 9/1993 Gagne ..... B24B 7/22 451/528
5,609,516 A * 3/1997 Courson ..... B24B 23/028 451/359
5,911,620 A * 6/1999 Spangenberg ..... B24D 7/18 451/540
6,299,522 B1 * 10/2001 Lee ..... B24B 55/102 451/488
D472,565 S * 4/2003 Amamoto ..... D15/126
D474,954 S * 5/2003 Kim ..... D15/126
D477,207 S * 7/2003 Kim ..... D8/70
6,758,732 B1 7/2004 Hilton
6,966,826 B2 * 11/2005 Suzuki ..... B24D 7/10 451/450
7,033,262 B2 * 4/2006 Takizawa ..... B24D 9/085 451/359
7,147,548 B1 * 12/2006 Mehrabi ..... B24B 7/186 125/38
7,147,549 B2 * 12/2006 Valentini ..... B24B 23/02 451/344
D548,757 S * 8/2007 Ruan ..... D15/126
D559,649 S * 1/2008 Ahn ..... D8/70
7,458,884 B2 * 12/2008 Falk ..... B24B 55/102 451/359
7,670,208 B2 * 3/2010 Thysell ..... B24D 7/066 125/3
8,303,374 B2 * 11/2012 Thysell ..... B24B 7/186 451/353
9,302,365 B2 * 4/2016 Valentini ..... B24B 23/02
2005/0164620 A1 * 7/2005 Amamoto ..... B23C 5/006 451/548
2005/0233681 A1 * 10/2005 Jost ..... B23Q 11/0046 451/49
2008/0176498 A1 * 7/2008 Rossi ..... B24B 7/186 451/508
2008/0182487 A1 * 7/2008 Muller ..... B24D 13/18 451/53
2009/0098808 A1 * 4/2009 Kajiyama ..... B24B 1/00 451/41
2010/0081363 A1 * 4/2010 Dahlheimer ..... B24D 7/10 451/28
2010/0136889 A1 * 6/2010 Kilgren ..... B24D 7/066 451/41
2010/0323594 A1 * 12/2010 Sun ..... B24D 9/08 451/360
2013/0052922 A1 * 2/2013 Ahn ..... B24D 7/10 451/488
2014/0242891 A1 * 8/2014 Kildevaeld, III ..... B24B 55/102 451/490
2015/0283670 A1 * 10/2015 Tsuno ..... B24B 53/007 134/23

FOREIGN PATENT DOCUMENTS

EP 1580801 A1 9/2005
EP 1955809 A1 8/2008
EP 2347857 A2 7/2011
KR 10-2011-0058541 A 6/2011
WO 02062524 A1 8/2002
WO 2004108352 A2 12/2004
WO 2006031044 A1 3/2006

* cited by examiner

CARRIER DISK, SYSTEM COMPRISING SUCH CARRIER DISK AND FLOOR GRINDING MACHINE

REFERENCE TO RELATED APPLICATION

The present document claims priority from the Swedish national patent application SE1550043-2, filed on 20 Jan. 2015, the entire contents of which are herein incorporated by reference.

TECHNICAL FIELD

The present disclosure relates to a carrier disk for carrying one or more grinding tools and to a grinding machine comprising such a carrier disk.

BACKGROUND

Machines for grinding or polishing floors are known from e.g. WO02062524A1. Such machines may comprise a frame, a motor, one or more carrier disks for carrying one or more grinding tools and a transmission mechanism for transmitting power from the motor to the carrier disks.

A machine may comprise one, two, three, four, six or more carrier disks. Each carrier disk may carry one, two, three, four or more grinding tools.

The carrier disks may be rotatable relative to the frame. Moreover, the carrier disks may be arranged on a planet disk, which is rotatable relative to the frame, while the carrier disks are rotatable relative to the planet disk.

There are numerous mechanisms for causing the carrier disks and the planet disk to rotate relative one another and relative the frame.

When grinding or polishing floors, it is also desirable to be able to switch tools on the machine. Such switching may be needed due to tool wear, but also in order to change between different types or grades of grinding, polishing or cutting tools.

Mechanisms for releasably attaching a grinding tool to a carrier disk are disclosed in WO2004108352A2, U.S. Pat. No. 7,147,548B1 and WO2006031044A1.

It is known that in connection with grinding and polishing operations, it may be desirable reduce the temperature to which the grinding tools are subjected, in order to extend the life of the grinding tools. In particular diamond abrasive cutting, grinding or polishing tools are prone to degradation when subjected to elevated temperatures.

Conventionally, this has been achieved by applying a massive amount of water to the surface and the grinding tools. However, the water and grinding residue form a slurry, which may need to be collected and disposed of. The slurry is heavy and may linger on the surface, the machine and on the grinding tools.

To this end, it is known through e.g. EP1580801A1, to apply a very limited amount of cooling fluid to the grinding tools, such that the collected grinding residues remain dry.

There is, however, still a need for further improvements of the cooling of the type of grinding tools discussed above.

SUMMARY

An object of the present disclosure is to provide improved cooling of grinding tools and in particular of grinding tools of the type disclosed in WO2004108352A2, as such grinding tools are used on a large scale.

The invention is defined by the appended independent claims, with embodiments being set forth in the appended dependent claims, in the following description and in the drawings.

According to a first aspect, there is provided a carrier disk for holding at least one cutting, grinding or polishing element in a floor grinding machine. The carrier disk comprises a carrier body having a downwardly exposed face, at which the grinding element is arranged, an air supply opening formed in the carrier body, a plurality of flanges extending axially from the carrier body and between the opening and a radially outer edge of the carrier body. A "floor grinding machine" may be used for grinding and polishing of floor surfaces. In addition, such a machine may be used or milling-like operations on the floor surface, wherein a tool having one or more cutting edges is used to cut away the floor surface. Such cutting tools are used for removing e.g. floor coverings (plastic carpets or the like), adhesive, paint or transformed surfaces, such as stone surfaces infused with crystallization agent or sodium silicate.

At the air supply opening, air may be supplied either from an intake which is arranged above or below the flanges. Such intake may receive air in a radial direction or in an axial direction. Moreover, air may be fed through a shaft which rotates with the carrier disk.

Directions such as "upper", "lower", "vertical" and "downwardly" are used to describe the carrier disk when it is in its normal operating position, i.e. on a horizontal floor surface.

A carrier disk as set forth above has been found to provide an improved combination of cooling and dust removal properties, while maintaining user friendliness and compatibility with grinding tools which are readily available.

The cutting, grinding or polishing elements are cooled through conduction, i.e. heat is conducted away from the element to the carrier disk. Moreover, the elements and the carrier disk are cooled also through the convection caused by the air flowing radially outwardly past the elements.

The carrier disk may comprise downwardly extending flanges, which extend from a downwardly exposed face of the carrier body.

The carrier disk may be arranged to releasably hold a grinding tool, and the cutting, grinding or polishing element may then be bonded to the grinding tool.

The flanges may comprise at least one pair of attachment flanges which form an acute angle relative to each other, as seen in a plane containing the downwardly exposed face, and present respective side surfaces which are undercut.

The side surfaces which are undercut may face away from each other.

Alternatively, the side surfaces which are undercut may face towards each other.

The carrier disk as claimed in any one of the preceding claims, wherein the flanges extend substantially radially.

The term substantially radially is understood as extending from a radially central portion of the disk towards a radially peripheral portion of the disk, for example radially +/−10°, preferably +/−5° or +/−1°. In the alternative, flanges may be curved as seen in the plane of the downwardly exposed face. Moreover, flanges may be composed of a plurality of sub-flanges, which may be advantageous in that an increased surface for heat exchange between the flanges and the air flow is provided.

Radially extending flanges are advantageous where it is desirable to provide a carrier disk which can be rotated in either direction.

An air channel may extend between the opening and the peripheral edge.

The air channel may be formed by a spacing between a pair of adjacent flanges. The radially extending air channel may have a depth corresponding to the height of the flanges.

In the alternative, the air channel may be formed as a through hole, which is integrated with the carrier body.

As yet another alternative, the air channel may be is formed as a substantially axially extending recess in a mounting footprint area of the carrier disk. A mounting foot print area may be defined as an area corresponding to a size and extent of a grinding tool holder, as seen in a plane parallel with the downwardly exposed surface. Hence, an air channel may be formed by providing radially extending recesses, which may become closed downwardly by the grinding tool holder while having inner and outer openings for receiving and ejecting air, respectively.

The attachment flanges may be separated by at least one flange. The carrier disk may comprise one or more upwardly extending flanges, which extend from an upwardly exposed face of the carrier body.

At least one of the cutting, grinding or polishing element may be bonded to the carrier disk.

The cutting, grinding or polishing element may be axially spaced from a downwardly exposed face of the carrier disk.

The carrier body may comprise a lower portion presenting the downwardly exposed face and the opening, and an upper portion, which is vertically spaced from the lower portion and which comprises a mounting interface for mounting the carrier disk onto a grinding machine.

The lower portion may be connected to the upper portion by at least two bridge portions.

The bridge portions may be separated by a radially open inlet opening.

Each of the bridge portions may present a radial extent and tangential extent, wherein the tangential extent is greater than the radial extent.

The term "tangential" is used to indicate a direction which is perpendicular to the radial direction.

The bridge portions may have a radial extent which is less than a radial extent of the flanges, preferably less than 50% of the extent of the flanges, less than 30% of the extent of the flanges or less than 20% of the flanges.

The upper portion may present at least one axially open inlet opening, which is in fluid communication with a central portion of the downwardly exposed face.

The axially open inlet opening may be radially outside the mounting interface.

In the alternative, the axially open inlet opening may be radially within the mounting interface.

The upper portion may present a downwardly facing substantially conical surface.

At least some of the flanges may be integrated with the carrier body, preferably formed in one piece with the carrier body.

The carrier body may present at least one stabilizer protrusion, which is provided at a peripheral edge and which presents a radial extent and tangential extent, wherein the tangential extent is greater than the radial extent.

Such a stabilizer protrusion may increase rigidity of the carrier body and reduce vibrations.

According to a second aspect, there is provided a system comprising a carrier disk as described above, and at least one grinding tool, which is attachable to the carrier disk by engagement with the attachment flanges.

The grinding tool may comprise a grinding tool body presenting floor facing surface and pair of undercut tool body flanges which form an acute angle relative to each other, as seen in a plane containing the floor facing surface, and present respective side surfaces which are undercut, such that the grinding tool is attachable to the carrier disk by interaction between the tool body flanges and the attachment flanges.

As an alternative, the grinding tool may comprise a grinding tool body presenting a floor facing surface and a pair of tool body side edges which form an acute angle relative to each other, as seen in a plane containing the floor facing surface, and which taper in with in an axial direction away from the downwardly exposed surface of the carrier disk, such that the grinding tool is attachable to the carrier disk by interaction between the tool body side edges and the attachment flanges.

The side surfaces of the undercut tool body flanges may face towards each other or away from each other, depending on the configuration of the attachment flanges.

According to a third aspect, there is provided a floor grinding machine, comprising a motor, at least one carrier disk as described above, and a transmission mechanism for transferring motion from the motor so as to cause the carrier disk to rotate.

DETAILED DESCRIPTION

Figure 1:
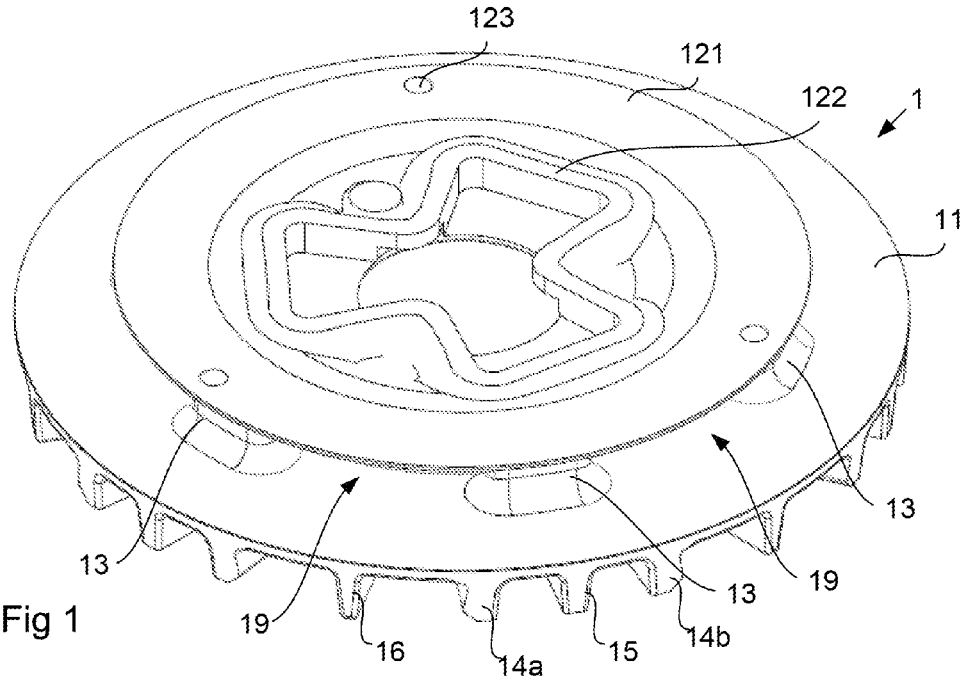
FIG. 1 is a schematic perspective view of a carrier disk 1 according to a first embodiment.
Figure 2:
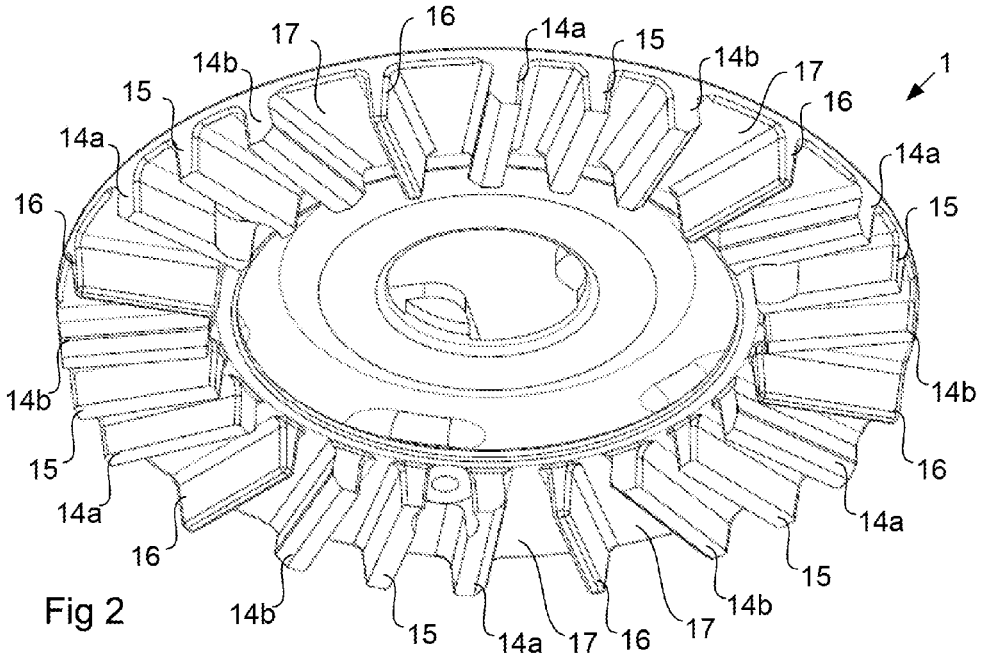
FIG. 2 is a schematic perspective view of the carrier disk 1 according to the first embodiment.
Figure 3:
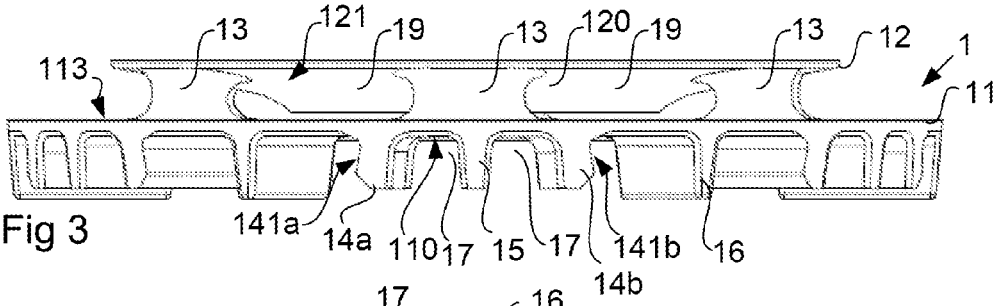
FIG. 3 is a schematic side view of the carrier disk 1 according to the first embodiment.
Figure 4:
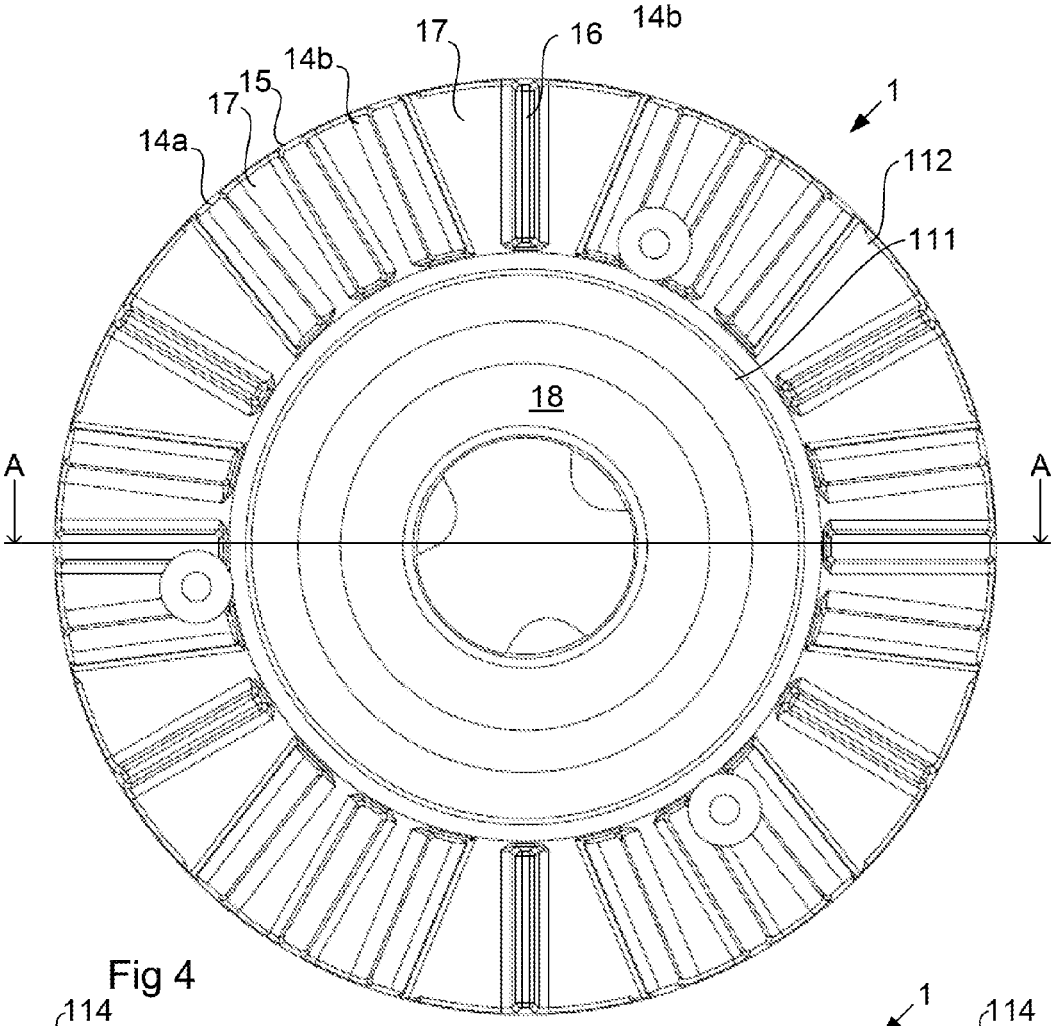
FIG. 4 is a schematic view from below of the carrier disk 1 according to the first embodiment.

FIGS. 1-6 schematically illustrate a carrier disk 1 according to a first embodiment. The carrier disk 1 comprises a lower portion (as seen when the carrier disk is in a working position on a floor) and an upper portion, i.e. a portion that is arranged at a higher vertical level than the lower portion when the carrier disk 1 is in the working position.

The lower portion 11 presents a downwardly facing surface 110, an upwardly facing surface 113 and a plurality of flanges 14*a*, 14*b*, 15, 16, which extend downwardly from the surface 110 and between a central portion 111 of the carrier disk 1 and a circumferential edge portion 112 of the carrier disk 1.

At the centre of the lower portion 11, there may be an opening 18. Hence, the lower portion may be substantially annular in shape.

The flanges 14*a*, 14*b*, 15, 16 may extend substantially radially, but it is possible to provide flanges which do not extend exactly radially. Using the terminology of fans, the flanges may be forward inclined, backward inclined, forward curved or backward curved. Moreover, flanges may be distributed into several radially and/or tangentially spaced apart parts.

Some of the flanges 14*a*, 14*b* are formed to provide attachment means for grinding tools. In the illustrated example, a pair of attachment flanges 14*a*, 14*b*, for attachment of a grinding tool of the type disclosed in WO2004108352A2, are provided, which form an acute angle in a plane parallel with the surface 110. The acute angle could have its apex radially inside the attachment flanges or radially outside the attachment flanges.

While flanges 15, 16 used only for cooling may extend radially, the attachment flanges' 14*a*, 14*b* directions may deviate from the radial direction in order to provide a suitable angle for allowing the grinding tool to self-lock when attached to the attachment flanges 14*a*, 14*b*.

The acute angle may be on the order of 1°-45°, preferably 5°-35° or 10°-30°.

The attachment flanges 14*a*, 14*b* present a respective undercut surface 141*a*, 141*b*, said undercut surfaces 141*a*, 141*b* facing away from each other and forming said acute angle.

The undercut side surfaces 141*a*, 141*b* may be substantially planar and they may present an angle relative to a plane normal to the face 110, which is large enough to retain the grinding tool even if the tool flanges are allowed to flex somewhat. The angle relative to the normal plane may be on the order of 1°-45°, preferably 5°-30° or 7°-20°.

Between the attachment flanges 14*a*, 14*b*, there may be at least one air channel 17 extending between the central portion 111 and the circumferential edge 112. Moreover, there may be one or more flanges 15 extending between the central portion 111 and the circumferential edge 112 provided in the space between a pair of attachment flanges 14*a*, 14*b*.

Between adjacent pairs of attachment flanges 14*a*, 14*b*, there may be further air channels 17 and flanges 16 extending between the central portion 111 and the circumferential edge 112.

Flanges 14*a*, 14*b*, 15, 16 may be integrated with the lower portion 11 of the carrier disk 1, such as formed in one piece or permanently attached by e.g. brazing or welding.

Alternatively, some or all flanges 14*a*, 14*b*, 15, 16 may be attached to the lower portion 11 by means of attachment means, which may or may not be releasable. Such attachment means include threaded connectors, rivets, snap-in connections and press fit connections.

The flanges 14*a*, 14*b*, 15, 16 may have different extents in the tangential direction, i.e. they may have different widths.

In particular, the attachment flanges 14*a*, 14*b* may have a greater extent in the direction perpendicular to the radial direction than at least some of the other flanges 15, 16.

The flanges 14*a*, 14*b*, 15, 16 may extend vertically, i.e. in a direction perpendicular to the surface 110, about 0.5-5 cm, preferably about 1-3 cm. The flanges' vertical extent may be constant over their radial extent, or it may taper outwardly or inwardly.

All flanges may have the same height. Alternatively, flanges of a particular class (e.g., the attachment flanges 14*a*, 14*b*) may have the same height, and this height may be greater or smaller than that of the other flanges 15, 16.

In particular flanges 15 that are arranged between a pair of associated attachment flanges 14*a*, 14*b* may be formed so as to have a vertical extent that cause the flange to abut the back side of the grinding tool, which may provide vertical support for the grinding tool and/or heat transfer from the grinding tool. In such an embodiment, the attachment flange may have a vertical extent that tapers towards a release direction of the grinding tool, such that an additional (in addition to the frictional engagement at the side surfaces 141*a*, 141*b*) frictional engagement between the grinding tool and the flange 15 may be provided.

The upper portion 12 comprises a body 120 forming or holding an attachment device 122 for attachment to a drive or driven axle of a grinding machine. A carrier disk may be attached directly and fixedly to the axle, or via a device which provides resilience or damping.

In the illustrated example, the attachment device is adapted for the applicant's presently used carrier disk connection interface.

The body 120 may present a downwardly facing surface 121, which is conical or curved as seen in a plane containing a rotation axis of the carrier disk. The body 120 and the surface 121 may have a radial extent which is at least as great as, and preferably greater than, the opening 18 of the lower portion 11.

The upper and lower portions may be connected to each other by a plurality of bridge portions 13. In the illustrated example, there are six bridge portions, but the number can be chosen as deemed fit.

Between the bridge portions, there are air inlet openings 19, which allow air to enter radially into the carrier disk 1.

The bridge portions 13 should be designed such that their effect as radial fan wings is less than that of the flanges 14*a*, 14*b*, 15, 16. For example, the radial extent of the bridge portions 13 may be less than the radial extent of the flanges 14*a*, 14*b*, 15, 16. Moreover, the bridge portions may have greater extent in the direction perpendicular to the radial direction than in the radial direction.

The lower 11 and upper 12 portions may be formed as separate parts, e.g. by forging, casting or assembly, which may be connected to each other, either permanently or releasably.

In the illustrated embodiment, holes 123 for bolts or screws are provided which may be used to connec the carrier disk to a carrier disk interface 106, 106', 106" of a grinding machine.

The bridge portions 13 may be formed in one piece with the upper and/or lower portion. Alternatively, the bridge portions may be formed as separate parts which are connected with the lower 11 and upper 12 portions when the carrier disk 1 is being assembled.

Figure 5:
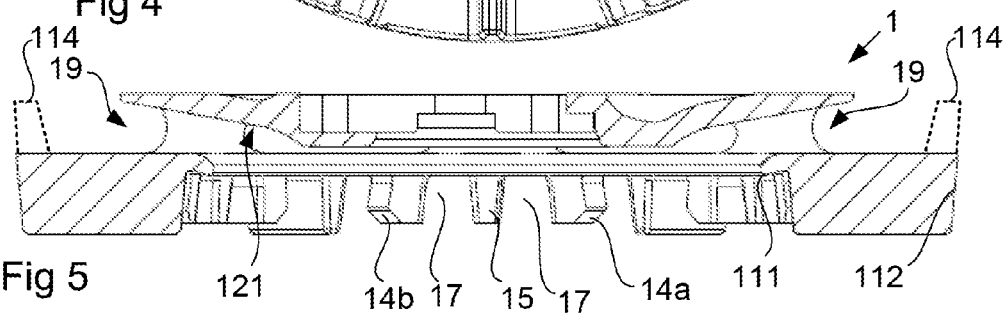
FIG. 5 is a schematic sectional view of the carrier disk 1 according to the first embodiment, taken along the line A-A in FIG. 4.

Referring to FIG. 5, dotted lines indicate stabilizer protrusions 114, which may be provided at an outer periphery of the lower portion 11. Such protrusions may be formed on or close to the edge portion 112 and may extend axially upwardly. The axial extent of the stabilizer protrusions 114 may be the same as an axial extent of the upper portion 12. A tangential length of each stabilizer protrusion 114 may be on the order of 5°-30°, preferably about 10°-20°.

The number of stabilizer protrusions may be 4-15, preferably 6-10, which may be regularly spaced along the outer peripheral edge 112 of the lower portion 11. A radial extent of each protrusion may be on the order of 1/50-1/10, preferably 1/30-1/15, of a radius of the lower portion.

In particular, the protrusions 114 may present a tangential extent which is sufficient to bridge at least two downwardly directed flanges, preferably at least three or four downwardly directed flanges.

The stabilizer protrusions may taper in height in the rotational direction and/or radially inwardly. In particular, each protrusion may, as seen in a tangential direction, present a pair of tapering portions which meet at an apex or which may be connected by a portion of even height.

In particular, the stabilizer protrusion 114 may present a radial extent and tangential extent, wherein the tangential extent may be greater than the radial extent.

Where bridge portions are present, the stabilizer protrusion may be spaced radially outside of the bridge portions.

Such stabilizer protrusions may increase the rigidity of the lower portion and counteract vibrations.

Optionally, stabilizer protrusions may connect to a radially outer edge portion of the upper portion 12 (not shown), which may provide further enhanced stability.

Figure 6:
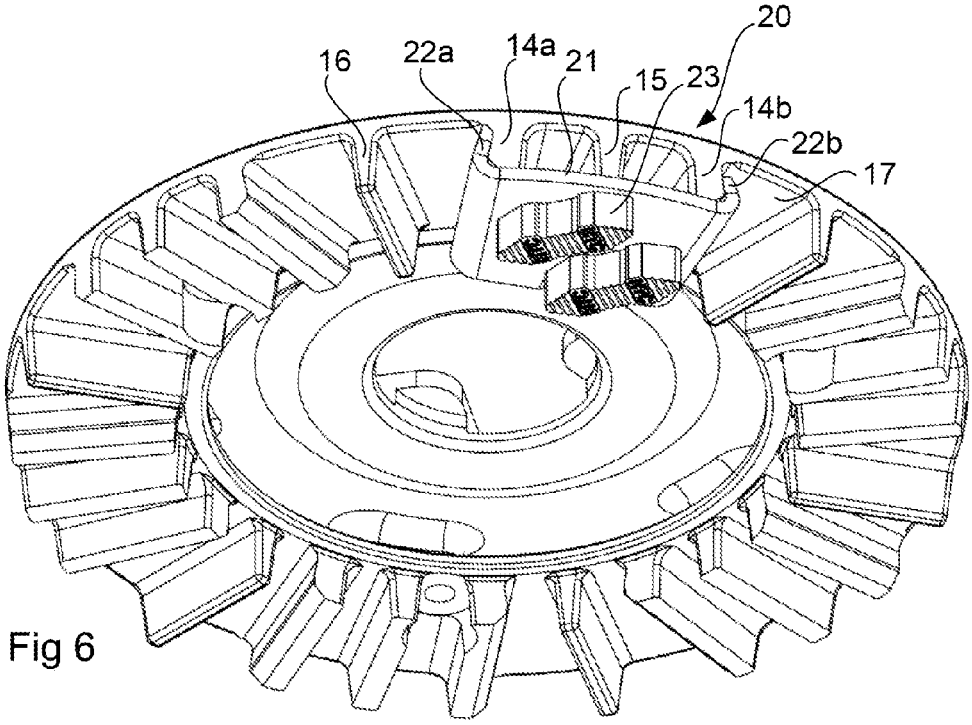
FIG. 6 is a schematic perspective view of the carrier disk 1 fitted with a grinding tool 2.

FIG. 6 schematically illustrates a carrier disk 1 with a grinding tool 20 mounted thereto. The grinding tool 20 comprises a tool carrier body and one or more tools, such as cutting edges, grinding segments 23, polishing segments and/or support segments (controlling e.g. cutting depth of a cutting edge.

The tool carrier body may be formed as is disclosed in WO2004108352A2, thus comprising a generally planar tool attachment portion 21 and a pair of flanges 22*a*, 22*b* extending from side edges of the tool attachment portion. The side edges of the tool attachment portion present an acute angle relative one another, as seen in the plane of the tool attachment portion 21. The flanges 22*a*, 22*b* extend from the respective side edge and inwardly, such that opposing undercut flange sides are provided. The undercut flange sides are adapted for interaction with a respective one of the side surfaces 141*a*, 141*b*.

The grinding tool 20 may be mounted onto the carrier disk 1 by fitting the flange sides 22*a*, 22*b* of the tool carrier body to surround the side surfaces 141*a*, 141*b* and then displacing the grinding tool 20 relative to the carrier disk 1, typically in the radial direction of the carrier disk 1, such that the grinding tool is releasably locked by means of friction force to the carrier disk 1.

Figure 7:
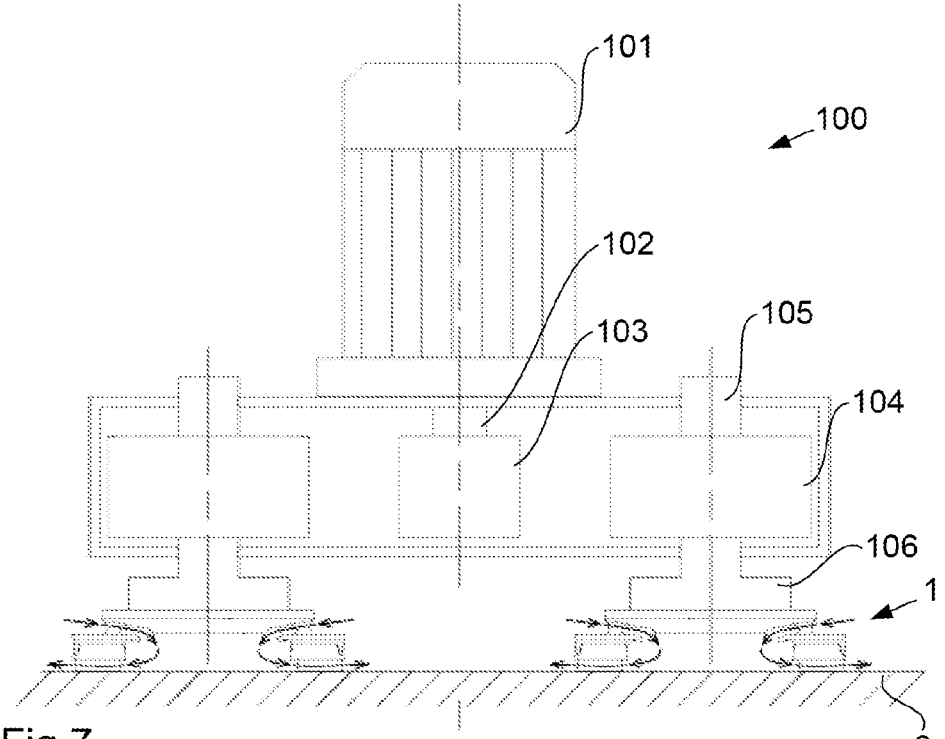
FIG. 7 is a schematic sectional view of a floor grinding machine 100 carrying a carrier disk 1 according to the first embodiment.

FIG. 7 schematically illustrates a floor grinding machine 100 comprising a motor 101, with an outgoing drive shaft 102 to which a drive pulley 103 is attached. The floor grinding machine is positioned in a floor 0 that is to be subjected to grinding, polishing or cutting action.

In FIG. 7, two a pair of carrier disks 1 are illustrated, each carrier disk 1 being connected to a driven axle 105, to which a driven pulley 104 is attached. The motor 101 may be directly connected to a carrier disk. In the alternative, a transmission comprising one or more belts, toothed belts, chains, gear wheels or friction wheels may be used to transfer the rotation power from the drive pulley 103 to the driven pulley 104. At the driven axle 105, a carrier disk interface 106 is attached. This interface may comprise the attachment mechanism and optionally any resilient or shock absorbing mechanism for compensating for unevenness in the floor, etc.

In FIG. 7, it is illustrated by arrows how air enters radially inwardly through the openings 19 between the lower and upper portions 11, 12 of the carrier disk 1, turns around at the central portion of the carrier disk 1 and proceeds radially outwardly from the central portion of the disk 1 through the action of the flanges 14*a*, 14*b*, 15, 16.

Figure 8:
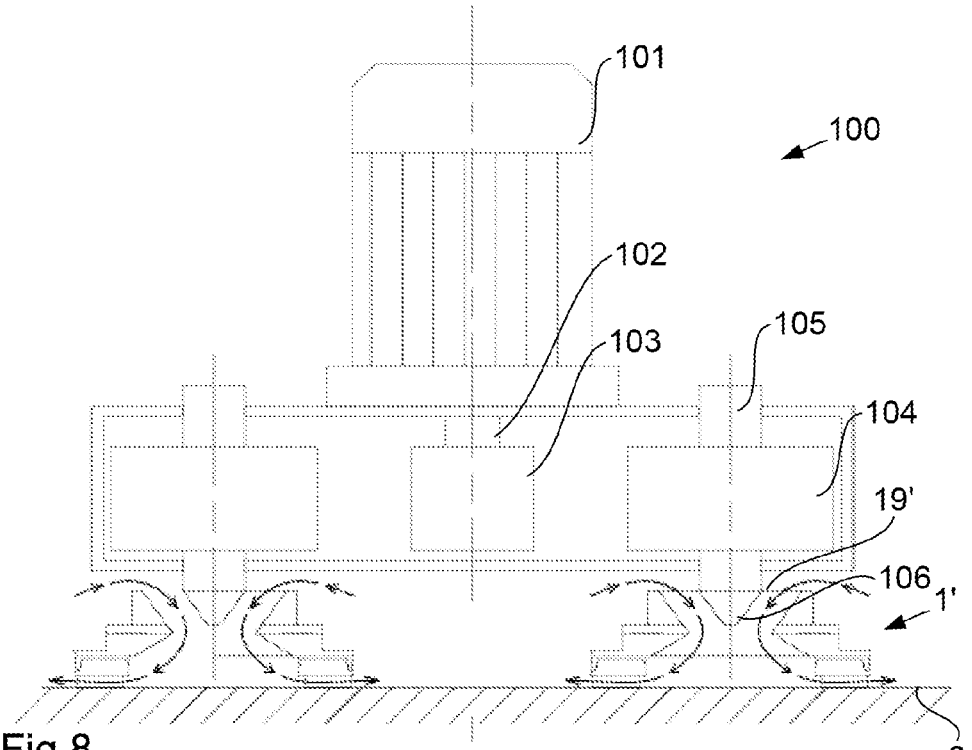
FIG. 8 is a schematic sectional view of a floor grinding machine 100 carrying a carrier disk 1' according to a second embodiment.

FIG. 8 schematically illustrates a floor grinding machine, which is similar to that of FIG. 7, with like parts having like reference numerals.

The floor grinding machine of FIG. 8 is provided with a different carrier disk interface 106' and with a different carrier disk 1'. The carrier disk interface 106' according to this embodiment has axially open air inlet openings 19', through which the air enters in an axial direction and proceeds downwardly through carrier disk interface 106' to the carrier disk 1' and exits in the same manner as described with respect to the carrier disk 1 illustrated in FIG. 7. In the embodiment illustrated in FIG. 8, the openings 19' may instead be radially open, e.g. as disclosed with respect to the embodiment of FIGS. 1-5.

It is possible to integrate the interface 106, 106', 106" with the carrier disk 1, 1', 1".

Hence, the lower portion 11 of the embodiment disclosed in FIG. 8 may be identical with that of the embodiment disclosed in FIG. 7, whereas the upper portion is different.

Figure 9:
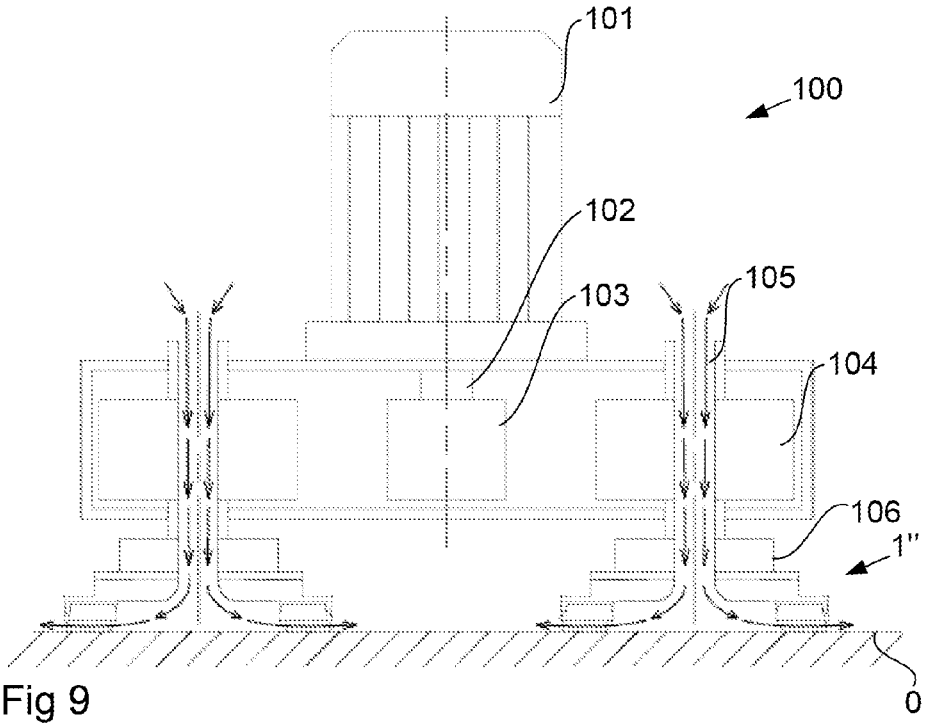
FIG. 9 is a schematic sectional view of a floor grinding machine 100 carrying a carrier disk 1" according to a third embodiment.

FIG. 9 schematically illustrates a floor grinding machine, which is similar to that of FIG. 7 and FIG. 8, with like parts having like reference numerals.

In the floor grinding machine of FIG. 9, the driven axle 105' is provided with an axially extending channel, through which air can enter from outside the grinding machine. The carrier disk interface 106" is thus provided with an air connection opening 19" that allows air to pass from the channel in the axle 105' and into the central part of the carrier disk 1".

Hence, the lower portion 11 of the embodiment disclosed in FIG. 9 may be identical with that of the embodiment disclosed in FIG. 7, whereas the upper portion may be different.

It is noted that in the embodiments of FIGS. 8 and 9, there is no need for an upper portion 12, but the carrier disk interface 106', 106" may connect directly to the carrier disk with air being supplied from the carrier disk interface directly to the lower portion 11.

Figure 10:
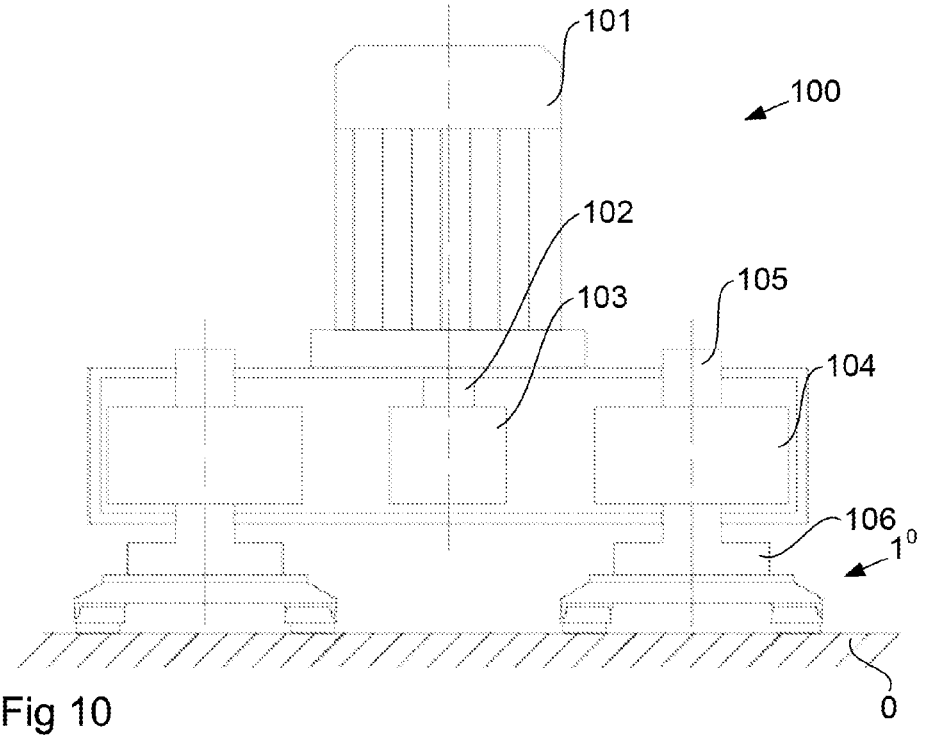
FIG. 10 is a schematic sectional view of a floor grinding machine 100 carrying a carrier disk $\mathbf{1}^{0}$ according to prior art.

FIG. 10 schematically illustrates a grinding machine 100 according to prior art, fitted with a carrier disk 10, which may be designed according to any of WO2004108352A2, U.S. Pat. No. 7,147,548B1 and WO2006031044A1.

It is understood that the carrier disks according to the present disclosure can be used with any type of drive mechanism.

Figure 11:
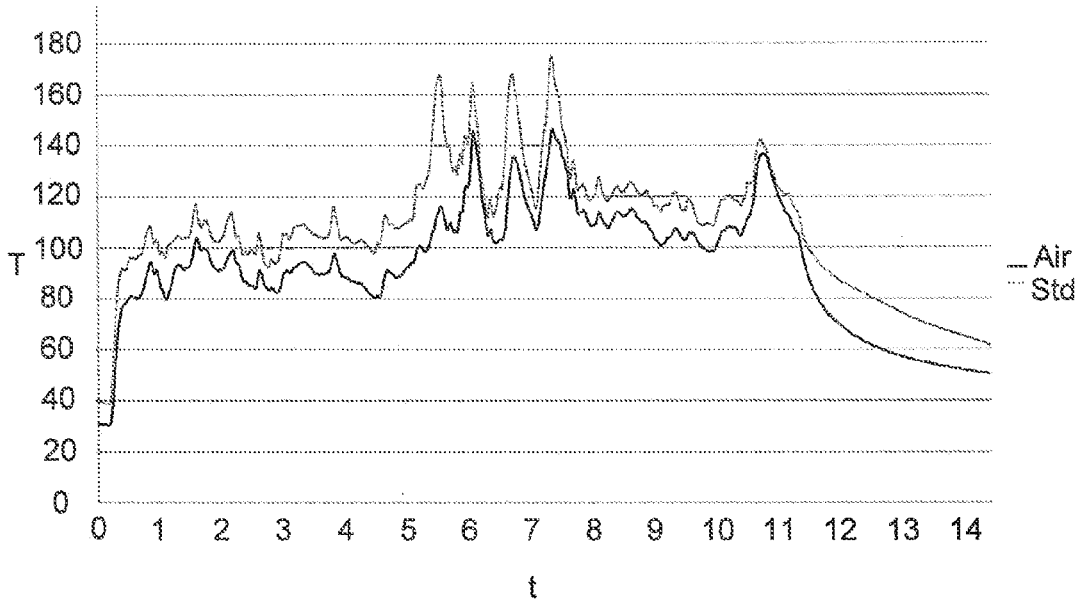
FIG. 11 is a graph illustrating the temperature (T) as a function of time (t) for a standard carrier disk (Std) compared to an air cooled carrier disk (Air) according to the present disclosure.

FIG. 11 is a graph disclosing the difference in temperature that can be achieved with an air cooled carrier disk 1 according to the first embodiment of the present disclosure as compared to a prior art carrier disk according to WO2004108352A2. All parameters were the same in both cases. No liquid coolant was added. A wireless data logger was arranged on the carrier disk with a sensor (K type thermo element) attached in a through hole such that temperature was measured at the interface between the abrasive element and the tool carrier body. Temperature measurements were logged at a rate of 5 Hz.

As can be seen from the graph in FIG. 11, the maximum temperature is on the order of 10-15% lower with the air cooled carrier disk 1 than with the standard carrier disk.

The carrier disk 1, 1', 1" may preferably be formed of a material having good heat conductivity and good properties of transferring heat to air. Examples of such materials include metallic materials, such as steel, aluminum or aluminum alloy, cupper or copper alloy, tin or tin alloy, or a combination thereof.

Typical rotational speeds at which the carrier disk 1, 1', 1" is to be rotated may range from about 300 rpm to about 3000 rpm.

In one alternative embodiment, a pair of adjacent attachment flanges present undercut surfaces which face each other and which form an acute angle in the plane parallel with the surface 110. The acute angle could have its apex radially inside the attachment flanges or radially outside the attachment flanges. Such an embodiment may be used together with grinding tools of the type disclosed in WO2006031044A1, see FIG. 13*f*.

Figure 12:
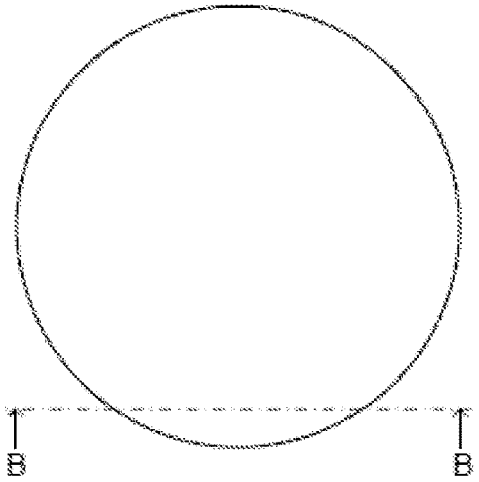
FIG. 12 is a schematic view from above of a carrier disk.

FIG. 12 schematically illustrates an outline of a carrier disk, as seen from above. The cross section of the lower portion 11, as seen along line B-B may be designed as described below with respect to any of FIGS. 13*a*-13*f*. The carrier disks of FIGS. 13*a*-13*e* may comprise an upper portion, which may be designed as described with reference to any of FIGS. 7-9.

Figure 13A:
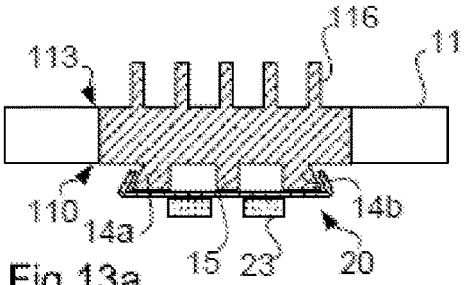
FIG. 13*a*-13*f* are schematic views along section B-B of FIG. 12, showing various alternative designs of carrier disks.

FIG. 13*a* schematically illustrates a carrier disk design as seen along the line B-B in FIG. 12. FIG. 13*a* schematically illustrates a carrier disk design similar to the one disclosed in FIGS. 1-5, but which is additionally provided with radially extending flanges 116 on an upwardly exposed face 113 of the lower portion 11.

A carrier disk having flanges 14*a*, 14*b*, 15, 16 on both upwardly 113 and downwardly 110 exposed faces of the lower portion 11 may have a central air supply channel as described above, which is arranged to receive air from an upper portion, which may be section arranged above the upwardly exposed flanges, such that both the upwardly 116 and the downwardly exposed flanges 14*a*, 14*b*, 15 may provide an air flow which moves radially outwardly. For example, air may be supplied in the manner illustrated in FIG. 8 or 9.

Figure 13B:
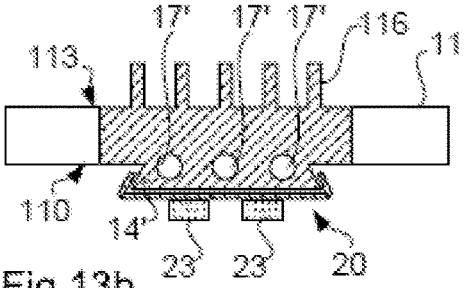

FIG. 13*b* schematically illustrates another possible design of a carrier disk as seen along the line B-B in FIG. 12. The carrier disk design illustrated in FIG. 13*b* presents a plurality of radially and upwardly extending flanges 116, i.e. flanges which extend from an upwardly exposed face 113 of a lower part 11 of a carrier disk.

The upwardly extending flanges 116 may be designed according to the same principles as those extending downwardly 15, 16, e.g. in that they extend substantially radially between a radially inner portion 111 of the carrier disk and a peripheral edge 112.

In FIG. 13*b*, there is further illustrated a downwardly exposed face 110 being provided with an attachment shoulder 14' having undercut edges, just like flanges 14*a*, 14*b*. In order to enhance the cooling further, such a shoulder may, but need not, be provided with one or more channels 17' which extend substantially radially through the shoulder and/or through the lower portion 11.

Figure 13C:
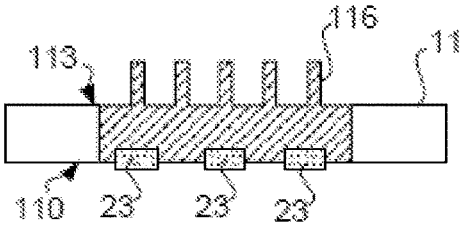

FIG. 13*c* schematically illustrates yet another possible design of a carrier disk as seen along the line B-B in FIG. 12. In FIG. 13*c*, abrasive elements 23 are fixedly connected at a downwardly exposed face 110 of the carrier disk. Such abrasive elements 23 may be mounted on the downwardly exposed face 110 or in recesses in the downwardly exposed face 110. The abrasive elements 23 may be flush with the downwardly exposed face, or they may extend downwardly from the downwardly exposed face 110. At least some (but not necessarily all) abrasive elements 23 which are fixedly connected to the carrier disk may be elongate and have their major side oriented substantially radially, such that they will operate as fan flanges.

Figure 13D:
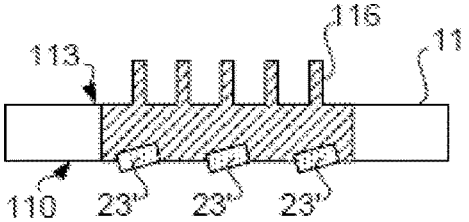

FIG. 13*d* schematically illustrates yet another possible design of a carrier disk as seen along the line B-B in FIG. 12. FIG. 13*d* corresponds to FIG. 13*c*, but instead of abrasive elements, the carrier disk may be provided with fixedly connected cutting elements 23', each of which provides a cutting edge arranged to provide a cutting action when engaging a floor surface, for removing greater amounts of material, including upper layers, coatings or residues of paint or glue.

A combination of FIGS. 13*c* and 13*d* is possible, wherein the carrier disk would be provided with a plurality of cutting elements 23', such as 3-20 cutting elements, and a plurality of abrasive elements 23 or support elements, such as 5-20 abrasive elements or support elements, i.e. elements which are arranged to limit cutting depth.

Figure 13E:
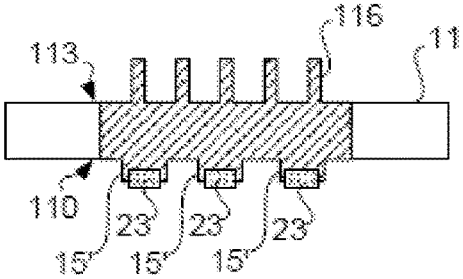

FIG. 13*e* schematically illustrates yet another possible design of a carrier disk, wherein flanges 116, 15' are provided on both the upwardly 113 and downwardly 110 exposed faces of the lower portion 11, and wherein abrasive elements 23 are arranged at axially free ends of the downwardly extending flanges 15'. The abrasive elements 23 may be of the same type as those described with reference to FIG. 13*c*. In the alternative, the abrasive elements of FIG. 13*e* may be replaced by cutting elements, abrasive elements and/or support elements, as described with reference to FIG. 13*d*.

Figure 13F:
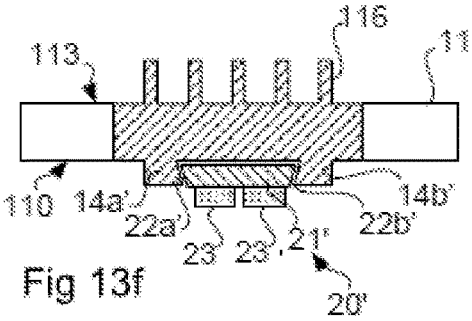

FIG. 13*f* schematically illustrates yet another possible design of a carrier disk, wherein downwardly extending flanges 14*a*', 14*b*' on the downwardly facing surface 110 present undercut surfaces which face each other and wherein a grinding tool 20' presents at least a portion a portion having side edges 22*a*', 22*b*' which taper in width in a direction away from the downwardly facing surface 110 of the carrier disk, so as to be able to engage the undercut surfaces of flanges 14*a*', 14*b*'.

Instead of the flanges 14*a*', 14*b*', grooves (not shown) may be provided in the lower portion 11, wherein the grooves provide undercut surfaces for engagement with the grinding tool 20'.

The grinding tool 20' may have a mounting surface for the abrasive elements, which may be flush with the downwardly exposed surface 110 or which may extend axially from the downwardly exposed surface. In the latter case, the mounting surface may extend horizontally beyond the tool body side edges (22*a*', 22*b*'), such that the tool body side edges form undercut surfaces as seen from the carrier disk.

An arrangement as disclosed in FIG. 13*f* need not have flanges on the upwardly facing surface 113, but may be designed generally in accordance with the embodiment disclosed in FIGS. 1-5. It may e.g. be adapted for use with the grinding tools of WO2006031044A1 or U.S. Pat. No. 7,147,548B1. The different arrangements of abrasive elements 23, 23' and/or grinding tools 20, 20' may be used with upwardly extending flanges, with downwardly extending flanges (FIGS. 13*a*, 13*b*, 13*e*, 13*f*) or with both.

The flanges described herein may extend straight in the axial direction, or they may be curved or slanted, i.e. non-perpendicular to the exposed surfaces 110, 113 of the carrier disk. It is also possible to attach the grinding tools 20. 20' to the carrier disk 1, 1', 1" by other means, such as snap connections, magnets or threaded connections.

The invention claimed is:

1. A system comprising:

a carrier disk for holding at least one cutting, grinding or polishing element in a floor grinding machine, and at least one grinding tool, which is releasably attachable to the carrier disk, wherein the cutting, grinding or polishing element is bonded to the grinding tool, the carrier disk comprising:

a carrier body having a downwardly exposed face at which the cutting, grinding or polishing element is arranged, wherein:

an air supply opening is formed in the carrier body, a plurality of downwardly extending flanges extend axially from the downwardly exposed face of the carrier body and between the air supply opening and a radially outer edge of the carrier body, the downwardly extending flanges comprise at least one pair of attachment flanges which form an acute angle relative to each other, as seen in a plane containing the downwardly exposed face and present respective side surfaces which are undercut, the grinding tool is attachable to the carrier disk by engagement with the pair of attachment flanges, the pair of attachment flanges are separated by at least one cooling flange which is provided in a space between the pair of attachment flanges, and an air channel extends between the air supply opening and the radially outer edge of the carrier body, wherein the air channel is formed by the space between the pair of attachment flanges.

2. The system as claimed in claim 1, wherein the side surfaces which are undercut face away from each other.

3. The system as claimed in claim 1, wherein the side surfaces which are undercut face towards each other.

4. The system as claimed in claim 1, wherein the downwardly extending flanges extend substantially radially.

5. The system as claimed in claim 1, wherein the air channel is formed by a spacing between a pair of adjacent attachment flanges.

6. The system as claimed in claim 1, wherein the air channel is formed as a substantially axially extending recess in a mounting footprint area of the carrier disk.

7. The system as claimed in claim 1, wherein the carrier disk comprises upwardly extending flanges, which extend from an upwardly exposed face of the carrier body.

8. The system as claimed in claim 1, wherein the carrier body comprises a lower portion presenting the downwardly exposed face and the air supply opening, and an upper portion, which is vertically spaced from the lower portion and which comprises a mounting interface for mounting the carrier disk onto a grinding machine.

9. The system as claimed in claim 8, wherein the lower portion is connected to the upper portion by at least two bridge portions.

10. The system as claimed in claim 9, wherein the bridge portions are separated by a radially open inlet opening.

11. The system as claimed in claim 9, wherein each of the bridge portions presents a radial extent and tangential extent, wherein the tangential extent is greater than the radial extent.

12. The system as claimed in claim 9, wherein the bridge portions have a radial extent which is less than a radial extent of the downwardly extending flanges.

13. The system as claimed in claim 1, wherein the carrier body presents at least one stabilizer protrusion, which is provided at a peripheral edge and which presents a radial extent and tangential extent, wherein the tangential extent is greater than the radial extent.

14. The system as claimed in claim 1, wherein at least some of the downwardly extending flanges are integrated with the carrier body.

15. The system as claimed in claim 1, wherein the grinding tool comprises a grinding tool body presenting a floor facing surface and a pair of undercut tool body flanges which form an acute angle relative to each other, as seen in a plane containing the floor facing surface, and present respective side surfaces which are undercut, such that the grinding tool is attachable to the carrier disk by interaction between the tool body flanges and the attachment flanges.

16. The system as claimed in claim 1, wherein the grinding tool comprises a grinding tool body presenting a floor facing surface and a pair of tool body side edges which form an acute angle relative to each other, as seen in a plane containing the floor facing surface, and which taper in width in an axial direction away from the downwardly exposed surface of the carrier disk, such that the grinding tool is attachable to the carrier disk by interaction between the tool body side edges and the attachment flanges.

17. A floor grinding machine, for cutting, grinding or polishing a floor surface, comprising:

a motor, and at least one system, comprising:

a carrier disk for holding at least one cutting, grinding or polishing element in said floor grinding machine, and at least one grinding tool, which is releasably attachable to the carrier disk, wherein the cutting, grinding or polishing element is bonded to the grinding tool, the carrier disk comprising:

a carrier body having a downwardly exposed face at which the cutting, grinding or polishing element is arranged, wherein:

an air supply opening is formed in the carrier body, a plurality of downwardly extending flanges extend axially from the downwardly exposed face of the carrier body and between the air supply opening and a radially outer edge of the carrier body, the downwardly extending flanges comprise at least one pair of attachment flanges which form an acute angle relative to each other, as seen in a plane containing the downwardly exposed face, and present respective side surfaces which are undercut, the grinding tool is attachable to the carrier disk by engagement with the pair of attachment flanges, the pair of attachment flanges are separated by at least one cooling flange which is provided in a space between the pair of attachment flanges, and an air channel extends between the air supply opening and the radially outer edge of the carrier body, wherein the air channel is formed by the space between the pair of attachment flanges, wherein the motor is arranged to cause the carrier disk of the system to rotate in a plane substantially parallel with the floor surface.

* * * * *